US008702975B2

(12) United States Patent
Gallup et al.

(10) Patent No.: US 8,702,975 B2
(45) **Date of Patent: *Apr. 22, 2014**

(54) PROCESS, METHOD, AND SYSTEM FOR REMOVING HEAVY METALS FROM FLUIDS

(75) Inventors: Darrell L. Gallup, Houston, TX (US); Sujin Yean, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 367 days.

This patent is subject to a terminal disclaimer.

(21) Appl. No.: 12/883,921

(22) Filed: Sep. 16, 2010

(65) Prior Publication Data

US 2012/0067784 A1 Mar. 22, 2012

(51) Int. Cl.
*C10G 21/16* (2006.01)
*C10G 21/24* (2006.01)
*C10G 21/00* (2006.01)

(52) U.S. Cl.
CPC ..... *C10G 21/16* (2013.01); *C10G 21/24* (2013.01); *C10G 21/00* (2013.01); *C10G 2300/205* (2013.01); *C10G 2300/44* (2013.01)
USPC ..... 208/251 R

(58) Field of Classification Search
USPC ..... 208/251 R, 252, 253
See application file for complete search history.

(56) References Cited

U.S. PATENT DOCUMENTS 3,873,581 A 3/1975 Fitzpatrick et al.
4,028,236 A 6/1977 Townsend et al.
4,094,098 A 6/1978 Gourley
4,094,777 A 6/1978 Sugier et al.
4,108,769 A 8/1978 Krieg et al.
4,133,755 A 1/1979 Tarao et al.
4,151,077 A 4/1979 Nogueira et al.
4,167,481 A 9/1979 Cremers et al.
4,230,486 A 10/1980 Capuano et al.
4,336,237 A 6/1982 Kudryk et al.
4,338,288 A 7/1982 Rollmann
4,354,942 A 10/1982 Kaczur et al.
4,474,896 A 10/1984 Chao
4,578,195 A 3/1986 Moore et al.
4,619,744 A 10/1986 Horton
4,678,584 A 7/1987 Elfline
4,708,853 A 11/1987 Matviya et al.
4,709,118 A 11/1987 Yan
4,752,397 A 6/1988 Sood
4,876,025 A 10/1989 Roydhouse
4,880,527 A 11/1989 Audeh
4,915,818 A * 4/1990 Yan ..... 208/251 R
4,981,577 A 1/1991 Audeh et al.
5,107,060 A 4/1992 Yan
5,110,480 A 5/1992 Yan
5,173,286 A 12/1992 Audeh
5,202,301 A 4/1993 McNamara
5,238,488 A 8/1993 Wilhelm
5,336,835 A 8/1994 McNamara
5,360,632 A 11/1994 Johnson et al.
6,077,421 A * 6/2000 Puranik et al. ..... 208/251 R
6,350,372 B1 2/2002 Degnan et al.
6,403,044 B1 6/2002 Litz et al.
6,475,451 B1 11/2002 Leppin et al.
6,521,131 B1 2/2003 Hamilton et al.
6,866,048 B2 3/2005 Mattox
7,591,944 B2 9/2009 Carnell et al.
7,666,318 B1 2/2010 Lehtinen et al.
7,744,763 B2 6/2010 Cross et al.
2003/0062316 A1* 4/2003 Mattox et al. ..... 210/700
2003/0226808 A1 12/2003 Fidoe et al.
2005/0241997 A1* 11/2005 Kremer et al. ..... 208/282
2005/0263739 A1 12/2005 Mattox et al.
2006/0048646 A1 3/2006 Olson et al.
2006/0065604 A1 3/2006 McKenna et al.
2006/0069169 A1 3/2006 Li et al.
2008/0283470 A1 11/2008 Gustafsson et al.
2009/0057232 A1 3/2009 Angeles-Boza et al.
2009/0114247 A1 5/2009 Brown et al.
2009/0304563 A1 12/2009 Harada et al.
2010/0000910 A1 1/2010 Gallup et al.
2010/0025184 A1 2/2010 Shibuya et al.
2010/0032344 A1 2/2010 Cross et al.
2010/0032345 A1 2/2010 Cross et al.
2010/0051553 A1 3/2010 Walterick et al.
2010/0078358 A1 4/2010 Tullos et al.
2010/0099596 A1 4/2010 Trahan
2010/0126909 A1 5/2010 Bhasin et al.

OTHER PUBLICATIONS

Ashworth, S. C., "Mercury Removal at Idaho National Engineering and Environmentally Laboratory's New Waste Calciner Facility," *Waste Management*, Feb. 27-Mar. 2, 2000, INEEL, Bechtel BWXT Idaho, LLC, Tuscon, AZ, pp. 1-20.

(Continued)

*Primary Examiner* — Prem C Singh
*Assistant Examiner* — Brandi M Doyle

(57) ABSTRACT

Trace levels of heavy metals in fluids such as crude oil are reduced by contacting the crude oil with a composition comprising a compound of Formula (I), wherein X is an anion of valency n, the number of phosphonium cations present. In one embodiment, the composition further comprises a complexing additive comprising an amine or corresponding ammonium derivative. Upon contact with the crude oil, the heavy metals form soluble complexes with the compound of Formula (I) for subsequent removal from the crude oil via phase separation.

18 Claims, 1 Drawing Sheet

(56) References Cited

OTHER PUBLICATIONS

Campanella et al., "Mercury Removal from Petrochemical Wastes," *Water Research*, 1986, vol. 20, No. 1, pp. 63-65.
Carnell et al., "Mercury Matters," *Hydrocarbon Engineering*, Dec. 2005, 4 pages.
Chaiyasit et al., "Decontamination of Mercury Contaminated Steel (API 5L-X52) Using Iodine and Iodide Lixiviant," *Modern Applied Science*, Jan. 2010, vol. 4, No. 1, pp. 12-20.
Clever et al., "The Solubility of Mercury and Some Sparingly Soluble Mercury Salts in Water and Aqueous Electrolyte Solutions," *Journal of Physical and Chemical Reference Data*, 1985, vol. 14, No. 3, pp. 631-680.
Corvini et al., "Mercury Removal from Natural Gas and Liquid Streams," *UOP LLC*, 2002, Houston, TX, pp. 1-9.
Findlay et al., "Removal of Elemental Mercury from Wastewaters Using Polysulfides," *Environmental Science and Technology*, Nov. 1981, vol. 15, No. 11, pp. 1388-1390.
Gildert et al., "Mercury Removal from Liquid Hydrocarbons in Ethylene Plants," *AIChE Paper No. 135c*, Mar. 24, 2010, Spring National Meeting, San Antonio, TX, 14 pages.
Kim et al., "Demulsification of Water-In-Crude Oil Emulsions by a Continuous Electrostatic Dehydrator," *Separation Science and Technology*, 2002, vol. 37, No. 6, pp. 1307-1320.
Larson et al., "Mass-Transfer Model of Mercury Removal from Water via Microemulsion Liquid Membranes," *Industrial & Engineering Chemistry Research*, 1994, vol. 33, No. 6, pp. 1612-1619.
Lemos et al., "Demusification of Water-in-Crude Oil Emulsions Using Ionic Liquids and Microwave Irradiation," *Energy Fuels*, 2010, vol. 24, pp. 4439-4444.
Morel et al., "The Chemical Cycle and Bioaccumulation of Mercury," *Annual Review Ecology, Evolution, and Systematics*, 1998, vol. 29, pp. 543-566.
Núñez et al., "Leaching of Cinnabar with HCI-Thiourea Solutions as the Basis of a Process for Mercury Obtention," *Metallurgical Transactions B*, Sep. 1996, vol. 17B, pp. 443-448.
Sharma et al., "Chemical Demulsification ofNatural Petroleum Emulsions of Assam (India)," *Colloid & Polymer Science*, 1982, vol. 260, pp. 616-622.
Sizeneva et al., "Applied Electrochemistry and Corrosion Protection of Metals: Mercury Passivation Solutions of Potassium Chloride and Sodium Hydroxide and Hypochlorite," *Russian Journal of Applied Chemistry*, 2009, vol. 82, No. 1, pp. 52-56.
Sizeneva et al., "Inorganic Synthesis and Industrial Inorganic Chemistry: A Study of Mercury Dissolution in Aqueous Solutions of Sodium Hypochlorite," *Russian Journal of Applied Chemistry*, 2005, vol. 78, No. 4, pp. 546-548.
Venkatesan et al., "Removal of Complexed Mercury by Dithiocarbamate Grafted on Mesoporous Silica," *Journal of Radioanalytical and Nuclear Chemistry*, 2003, vol. 256, No. 2, pp. 213-218.
Waldo, John H., "Some New Water-Soluble Organo-Mercury Compounds," *Water Soluble Organo Compounds*, Mar. 6, 1931, vol. 53, pp. 992-996.
Wasay et al., "Remediation of a Soil Polluted by Mercury with Acidic Potassium Iodide," *Journal of Hazardous Materials*, 1995, vol. 44, pp. 93-102.
Yuan et al., "Fractions and Leaching Characteristics of Mercury in Coal," *Environmental Monitoring and Assessment*, Jan. 6, 2009, vol. 167, pp. 581-586.
Zhao et al., "Removal of Elemental Mercury by Sodium Chlorite Solution," *Chemical Engineering & Technology*, 2008, vol. 31, No. 3, pp. 350-354.
PCT International Search Report and Written Opinion, International Application No. PCT/US2011/050950, dated Apr. 20, 2012, pp. 1-11.
PCT International Preliminary Report on Patentability, International Application No. PCT/US2011/050950, dated Mar. 19, 2013.

* cited by examiner

PROCESS, METHOD, AND SYSTEM FOR REMOVING HEAVY METALS FROM FLUIDS

CROSS-REFERENCE TO RELATED APPLICATIONS

NONE.

TECHNICAL FIELD

The invention relates generally to a process, method, and system for removing heavy metals such as mercury and the like from hydrocarbon fluids such as crude oil.

BACKGROUND

Heavy metals such as lead, zinc, mercury, silver, arsenic and the like can be present in trace amounts in all types of fuels such as crude oils. The amount can range from below the analytical detection limit (0.5 μg/kg) to several thousand ppb depending on the feed source. It is desirable to remove the trace elements of these metals from crude oils.

Various methods for removing trace metal contaminants in liquid hydrocarbon feed prior to fractional distillation have been developed. U.S. Pat. No. 6,350,372 B1 discloses utilizing a solubilized sulfur compound in combination with an absorbent carrier. U.S. Pat. No. 4,474,896 claims the use of absorbent compositions, mainly polysulfide based, for removal of elemental mercury from gaseous and liquid hydrocarbon streams. The use of absorbent includes a number of less than desirable attributes. Absorbent beds tend to get clogged by solid particulates in the crude, thus impeding the flow of the feed. Absorbents can also be very costly due to the large quantity needed. In U.S. Pat. No. 4,915,818, removal of mercury from liquid hydrocarbon condensate is disclosed. In this method, the liquid hydrocarbons are treated with a dilute aqueous solution of alkali metal sulfide salt.

There is still a need for improved methods for trace elements extraction from hydrocarbons.

SUMMARY OF THE INVENTION

In one embodiment, the invention relates to a method to reduce or remove trace elements such as mercury from a crude oil, comprising mixing the crude oil having a first concentration of the trace element with a composition comprising a compound of Formula (I) in an aqueous solvent for a sufficient amount of time to form an oil-water emulsion with the water containing a complex formed by the compound of Formula (I) chemically reacting with the trace elements;

(I)

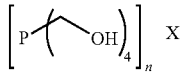

The water containing the heavy metal complex is separated from the crude oil in a phase separation device, for a crude oil having reduced concentration of the trace element.

In yet another embodiment, the composition further includes a complexing additive selected from the group of amine or ammonium derivatives.

DETAILED DESCRIPTION

Figure 1:
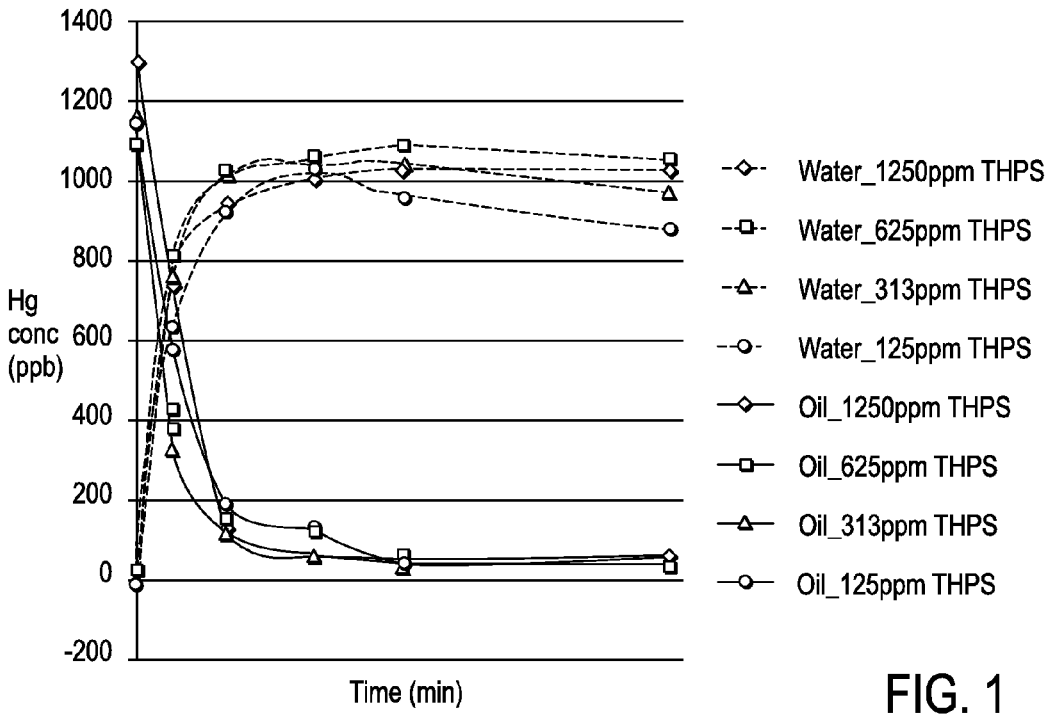
FIG. 1 is a graph correlating the mercury concentrations in oil and water at different THPS concentrations at different periods for Example 4.

The following terms will be used throughout the specification and will have the following meanings unless otherwise indicated.

"Crude oil" refers to natural and synthetic liquid hydrocarbon products including but not limited to petroleum products, intermediate petroleum streams such as residue, naphtha, cracked stock; refined petroleum products including gasoline, other fuels, and solvents. The liquid hydrocarbon products can be directly from oil wells or after the products have been further processed or derived. The term "petroleum products" refer to crude oil, solid, and semi-solid hydrocarbon products including but not limited to tar sand, bitumen, etc. The term "petroleum products" also refer to petroleum products derived from coal.

"Trace element" refers to the heavy metals such as mercury, lead, zinc, silver, etc. to be removed from the crude oil or for the concentration to be significantly reduced.

Mercury sulfide may be used interchangeably with HgS, referring to mercurous sulfide, mercuric sulfide, or mixtures thereof. Normally, mercury sulfide is present as mercuric sulfide with a stoichiometric equivalent of one mole of sulfide ion per mole of mercury ion.

"Mercury salt" or "mercury complex" means a chemical compound formed by replacing all or part of hydrogen ions of an acid with one or more mercury ions.

"Oil-water" as used herein means any mixture containing a crude oil with water, inclusive of both oil-in-water emulsions and water-in-oil emulsions. In one embodiment, the emulsion particles are of droplet sizes. In another embodiment, the emulsion particles are of micron or nano particle sizes. In one embodiment, oil is present as fine droplets contained in to water in the form of an emulsion, i.e., emulsified hydrocarbons, or in the form of undissolved, yet non-emulsified hydrocarbons.

Crudes and crude blends are used interchangeably and each is intended to include both a single crude and blends of crudes. The invention effectively decreases the levels of heavy metals such as mercury, lead, zinc, etc. from crude oil.

The crude oil is brought into contact with a composition wherein the heavy metals form water soluble complexes with the composition, with the water soluble complexes being removable/separated from the crude oil. In one embodiment for removing mercury (Hg) from crude oil, the composition not only dissolves solid forms of Hg, but also forms complexes with $Hg^{2+}$. The composition can be used in treating crude oil containing heavy metals such as mercury, and in another embodiment, for treating seawater used in the secondary recovery of crude oil containing a high level of mercury.

The Composition:

The composition for forming complexes with the heavy metals is selected from compounds of Formula (I):

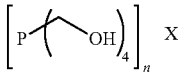

wherein X is an anion, e.g., a monoanion, dianion, or trianion, and n is the number of phosphonium cations present.

In one embodiment, X is chosen such that compounds of Formula (I) are soluble in water, alcohols, or in mixtures thereof. In one embodiment, X is a monoanion selected from the group of halides such as chloride, bromide, and iodide. In another embodiment, X is selected from the group of lower alkyl carboxylates, wherein the term "lower alkyl" refers to a straight or branched C1-C6 alkyl group, e.g., methyl carboxylate (i.e., acetate), ethyl carboxylate, and propyl and isopropyl carboxylates. In another embodiment, X is selected from sulfur-based anions such as bisulfite, bisulfate, and hydrocarbyl sulfonates. Examples of hydrocarbyl sulfonates include, but are not limited to, methylsulfonate, benzenesulfonate, para-toluenesulfonate, and the isomers of xylenesulfonate. In yet another embodiment, X is selected from monoanions such as nitrate and hexafluorophosphate.

In one embodiment, X is a dianion selected from sulfate, sulfite, and monohydrogenphosphate. In another embodiment, X is a trianion such as phosphate. Without wishing to be bound by any particular theory or principle, it is believed that compounds of Formula (I), particularly when exposed to aqueous solutions having elevated pH, furnish tris(hydroxymethyl)phosphine (TRIS) to dissolve compounds such as HgS and HgO.

Compounds of Formula (I) are commercially available or can be obtained routinely by known syntheses. Two examples are tetrakis(hydroxymethyl)-phosphonium sulfate (THPS) and tetrakis(hydroxymethyl)phosphonium chloride (THPCI), both of which are available commercially, for example, from Rhodia (Cranberry, N.J.), Nippon Industries (Tokyo, Japan), and Cytec Industries (Mobile, Ala.). Tetrakis (hydroxymethyl)phosphonium sulfate (THPS) is normally available as an aqueous acidic solution having a pH of between 1 and 4. Other compounds of Formula (I) bearing different anions X can be prepared straightforwardly by the well-known reaction between phosphine and formaldehyde in the presence of an aqueous acid HX as described in U.S. Pat. No. 4,044,055 to Katz et al, incorporated herein by reference.

The compounds of Formula (I) upon contact with the crude oil, will form water soluble complexes with the trace element of heavy metals in the crude oil. Examples of heavy metals include solids such as HgS, HgO, as well as water soluble $Hg^{+2}$, etc. In one embodiment, the composition further includes a complexing additive, which is an amine or its ammonium derivative, and can be selected from a variety of amines and their conjugate acids. Ammonium derivative is the conjugate acid of an amine. The complexing additive is combined with one or more compounds of Formula (I), resulting in effective scavengers of heavy metal compounds such as HgS, HgO, etc. in the crude oil.

In one embodiment wherein the complexing additive is a solid, then it should be soluble in the solvent as Formula (I). In another embodiment, if the amine or its conjugate acid is a liquid, then it is miscible with the solvent for use as Formula (I). One example of a complexing additive is ammonia. In another embodiment, the complexing additive is a primary amine, such as alkylamines. Exemplary alkylamines include, but are not limited to, methylamine, ethylamine, normal- and iso-propylamines, and normal- and tert-butylamines. Other primary amines include alkylenediamines, such as 1,2-diaminoethane and 1,3-diaminopropane. Still other primary amines are cycloalkylamines, such as cyclopropylamine, cyclobutylamine, cyclopentylamine, and cyclohexylamine. In yet another embodiment, the complexing agent is selected from ammonium derivatives of these amines. Examples include but are not limited to ammonium chloride, methylammonium chloride, ammonium nitrate, and ethylammonium chloride.

In one embodiment, the composition is prepared with at least a Formula (I) compound by itself, or a mixture of the Formula (I) compound with at least a complexing additive, for a pH value between 4.5 to about 10. In one embodiment, the pH is maintained in the range of about 6 to about 9. In another embodiment, the pH is maintained at a level of about 8.

In one embodiment, additives for crude oil treatment known in the art other than complexing agents can be optionally added to the composition. Examples include surfactants, biocides, water dispersants, demulsifiers, scale inhibitors, corrosion inhibitors, anti-foaming agents, oxygen scavengers, flocculants, and the like. The additives can be added as pure compounds or as commercially available preparations thereof, such as aqueous solutions.

The use of any amount of the composition is effective in removing or reducing the level of heavy metals such as mercury, lead, zinc, etc. from crude oil. In one embodiment, the optimum molar ratio depends somewhat upon the amine or ammonium derivative added to the composition.

In one embodiment, the composition of Formula (I) compound is employed in a molar ratio range of phosphorus to the heavy metal for removal, e.g., mercury, of 1:1 to 50:1. In one embodiment, the ratio is greater than 10:1. In another embodiment, it is less than 100:1. In a third embodiment, it is greater than 20:1. In another embodiment with the use of a complexing additive, the molar ratio varies somewhat upon the amine or ammonium derivative added, and can be determined by routine experimentation. In yet another embodiment for mercury removal/reduction, the molar ratio of phosphorus to mercury is in the range of 1.5:1 to 7:1. In a third embodiment, the ratio is in the range of 2:1 to 5:1.

Method for Removing/Decreasing Levels of Heavy Metals in Crude Oil:

In one embodiment, the composition is first prepared or obtained.

In one embodiment with an optional complexing agent, the composition is made by combining suitable amounts of at least one compound of Formula (I) and at least one amine or ammonium derivative in the presence of an aqueous solvent. The order of addition of the reagents can be varied. In one embodiment, the amine or ammonium derivative is added to a solution of a compound of Formula (I) wherein the pH has been adjusted as described below. Exemplary solvents include water and an alcohol. In one embodiment, the added reagents make up from 0.5 to 50 volume percent of the total mixture of crude oil and reagents. In a second embodiment, the added reagents make up less than 40 vol. % of the mixture. In a third embodiment, less than 30 vol. %. In a fourth embodiment, less than 10 vol. % percent. In a fifth embodiment, less than 5 vol. %.

In another embodiment wherein commercially available aqueous solutions of tetrakis(hydroxymethyl)phosphonium sulfate are used, the pH of the composition is raised by adding a suitable base to the mixture. The pH can be maintained by the use of a buffer. Exemplary buffers, such as phosphate and citrate, are serviceable in the prescribed pH range. Additionally, nitriloacetic acids can be used as buffers. Exemplary acids include nitrilotriacetic acid (NTA) and ethylenediamine-N,N,N',N'-tetraacetic acid (EDTA).

In the next step, the composition is brought in contact with the crude oil containing heavy metals, e.g., trace elements of mercury, and the like, by means known in the art. The composition can be introduced continuously or intermittently, i.e., batch-wise, into operating gas or fluid pipelines, for example. Alternatively, batch introduction is effective for offline pipelines. The contact can be at any temperature that is sufficiently high enough for the crude oil to be completely liquid. In one embodiment, the contact is at room temperature. In another embodiment, the contact is at a sufficiently elevated temperature, e.g., at least 50° C.

The contact is for a sufficient amount of time for the trace elements to be sufficiently removed from the crude oil. The sufficient amount of time is dependent on the mixing of the crude oil with the composition. If vigorous mixing is provided, the contact time can be as little as less than a minute. In one embodiment, the contact time is at least a minute. In another embodiment, the contact time is at least 5 minutes. In a third embodiment, at least 1 hr. In a fourth embodiment, the contact is continuous for at least 2 hrs.

Upon contact with the crude oil, the composition reacts with the trace elements in the crude oil forming water soluble complexes.

Once an oil-water emulsion is formed, the water phase containing the heavy metal complexes can be separated from the crude oil in a phase separation device known in the art, e.g., a cyclone device, electrostatic coalescent device, gravitational oil-water separator, centrifugal separator, etc., resulting in a crude oil with a significantly reduced level of heavy metals. The heavy metal complexes can be isolated/extracted out of the effluent and subsequently disposed.

In one embodiment with mercury as the heavy metal for trace element removal or reduction, the mercury level in the crude oil is reduced to 100 ppb or less. In another embodiment, the level is brought down to 50 ppb or less. In a third embodiment, the level is 20 ppb or less. In a fourth embodiment, the level is 10 ppb or less. In a fifth embodiment, the level is 5 ppb or less. In yet another embodiment, the removal or reduction is at least 50% from the original level of heavy metals such as mercury. In a fifth embodiment, at least 75% of a heavy metal such as mercury is removed. In a seventh embodiment, the removal or the reduction is at least 90%.

In one embodiment, mercury is the heavy metal targeted to be removed/reduced in concentration with the compound of Formula (I) forming a mercury salt complex. The mercury salt complex can be subsequently removed through techniques such as filtration, coagulation, flotation, co-precipitation, ion exchange, reverse osmosis, ultra-filtration using membranes and other treatment processes known in the art.

EXAMPLES

The following examples are given to illustrate the present invention. It should be understood, however, that the invention is not to be limited to the specific conditions or details described in these examples. In examples calling for mercury vapor feed prep, a sufficient amount of mercury (e.g., one or two drops of elemental mercury in a bottle) was sparged by using nitrogen ($N_2$) gas into another bottle containing white mineral oil overnight.

Example 1

Scanning UV for Complex Formation of Heavy Metals with THPS and THPCI

Samples of mercuric chloride ($HgCl_2$) were prepared in water according to recipe: 21.3 mg of $HgCl_2$ in 10 mL of diluents (0.008 moles/mL) and 61.2 mg of $HgCl_2$ in 25 mL of diluents (0.009 moles/mL). A sample of mercury oxide (HgO) dissolved in nitric acid was provided. The mercury samples were spiked with 75% THPS or 80% THPCI at different molar ratio concentrations: 1:0, 1:1, 1:2, 1:3, 1:4, 1:6, and 1:9. Treated mercury solutions were scanned by UV and compared with untreated solutions. The results from UV scanning showed that $HgCl_2$ and HgO formed complexes with THPS and THPCI.

Example 2

The experiment showed that THPS is a complexing agent for mercury after iodine ($I_2$) oxidation in Hg vapor feed prep. Mercury level in 50 mL of distilled water in a 250 mL glass reactor was measured using LUMEX mercury analyzer equipped with PYRO-915+. 50 mL of mercury vapor feed prep containing approximately 1,400 ppb Hg was added to the water. A pre-determined volume of iodine stock prepared in methanol (3% $I_2$ by weight) was added to the reactor for a final iodine concentration of 50 ppm. The oil-water mixture was stirred up for 1 minute with an overhead agitator at 600 rpm. THPS stock (50 wt. %) was added to the reactor for samples with predetermined concentrations. Mixing resumed for another minute at 600 rpm. Aliquots of both oil and water were analyzed for mercury concentration.

Example 3

THPS Dissolving HgS and HgO to Form Soluble Complexes

Samples of 27±3 mg of HgO yellow, HgO red and β-HgS; or 30±10 mg of α-HgS were added into 50 mL glass bottles. For each glass bottle, 10 mL of THPS was added for three different concentrations of THPS. The samples were stirred with a magnetic bar for 18 hrs. The samples were filtered with a 0.45 μm filter to separate liquid from mercury solids. Mercury levels in the filtrates were measured using LUMEX mercury analyzer equipped with PYRO-915+.

Table 1 shows the solubility of HgS and HgO by THPS with the extracted Hg concentration as mg Hg/kg HgO or HgS:

TABLE 1

| | HgO, yellow | HgO, red | α-HgS | β-HgS |
|---|---|---|---|---|
| Deionized distill water | 545 | 506 | 209 | 143 |
| THPS (10-30 wt. %) | 9,428 | 9,642 | 1,198 | 2,204 |
| THPS (10-30 wt. %) | 4,597 | 18,707 | 1,178 | 1,597 |
| THPS (70-80 wt. %) | 66,976 | 59,884 | 4,927 | 18,031 |

As shown, sulfides and oxides of heavy metals are soluble in THPS solutions, with examples showing that mercury sulfides and oxides can be easily dissolved by using the composition of Formula (I).

Example 4

Example 2 was repeated, except that the oil-water mixture was stirred up for 2 minutes with an overhead agitator at 600 rpm, and THPS stock (50 wt. %) was added to the reactor for samples with concentrations of 1250, 625, 313, and 125 ppm THPS. Aliquots of both oil and water were collected and analyzed for mercury concentration after mixing at 600 ppm, and at intervals of 2, 5, 10, 15 and 30 minutes. FIG. 1 illustrates the mercury concentrations in oil and water at different THPS concentrations at different periods.

Example 5

Figure 2:
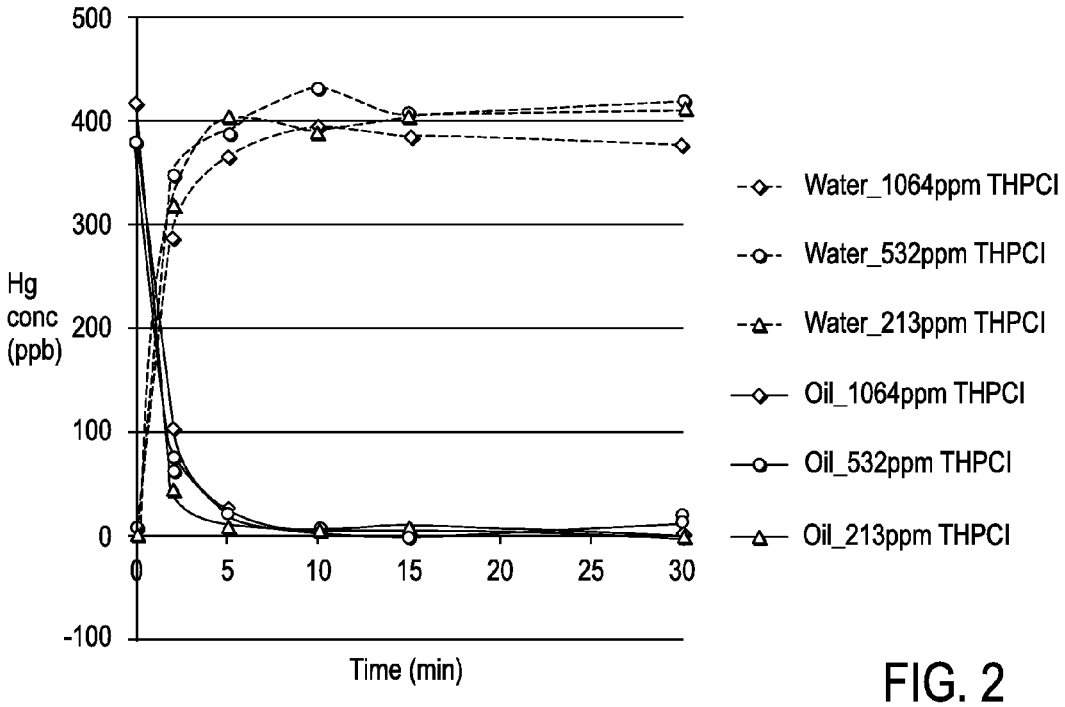
FIG. 2 correlates the mercury concentrations in oil and water at different THPCI concentrations at different periods for Example 5.

Example 4 was repeated, except that THPCI stock at 80 wt. % was added to the reactor for samples with concentrations of 1064, 532, and 213 ppm THPCI. FIG. 2 shows the mercury concentrations in oil and water at different THPCI concentrations at different periods.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A method for reducing mercury in a crude oil, comprising:

providing a crude oil containing mercury in an oil-water emulsion;

mixing the crude oil with a composition comprising a compound of Formula (I) in an aqueous solvent for a sufficient amount of time for the compound to form a water soluble mercury complex in the oil-water emulsion;

(I)

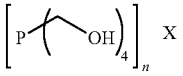

wherein X is an anion of valency n; and separating the oil-water emulsion in a phase separation device to obtain a water phase containing the water soluble mercury complex and a crude oil having a reduced concentration of mercury.

2. The method of claim 1, wherein X is selected from the group consisting of chloride, bromide, iodide, lower alkyl carboxylates, bisulfate, bisulfate, hydrocarbyl sulfonates, dihydrogenphosphate, nitrate, hexafluorophosphate, sulfate, sulfite, monohydrogenphosphate, and phosphate.

3. The method of claim 2, wherein the compound of Formula (I) is selected from tetrakis(hydroxymethyl)phosphonium sulfate and tetrakis(hydroxymethyl)phosphonium chloride.

4. The method of claim 3, wherein the compound of Formula (I) is tetrakis(hydroxymethyl)phosphonium sulfate.

5. The method of claim 3, wherein the compound of Formula (I) is tetrakis(hydroxymethyl)phosphonium chloride.

6. The method of claim 1, wherein the reduced concentration is less than 100 ppb mercury.

7. The method of claim 6, wherein the reduced concentration is less than 50 ppb mercury.

8. The method of claim 7, wherein the reduced concentration is less than 20 ppb mercury.

9. The method of claim 8, wherein the reduced concentration is less than 10 ppb mercury.

10. The method of claim 1, wherein the composition further comprises an amine or ammonium derivative.

11. The method of claim 10, wherein the amine or ammonium derivative is selected from the group consisting of alkylamines and their conjugate acids thereof.

12. The method of claim 11, wherein the alkylamine and conjugate acids thereof is selected from the group consisting of methylamine, ethylamine, propylamine, isopropylamine, butylamine, tertbutylamine, and conjugate acids thereof.

13. The method of claim 1, wherein the compound having Formula (I) is mixed into the crude oil at a molar ratio to mercury in the range of 1:1 to 50:1.

14. The method of claim 13, wherein the molar ratio is in the range of 1.5:1 to 10:1.

15. The method of claim 13, wherein the molar ratio is in the range of 2:1 to 5:1.

16. A method for reducing mercury in a crude oil, comprising:

providing a crude oil containing mercury in an oil-water emulsion;

mixing the crude oil with a composition comprising an amine or ammonium derivative with tetrakis(hydroxymethyl)phosphonium sulfate for a sufficient amount of time to form a water soluble mercury complex in the oil-water emulsion; and separating the oil-water emulsion in a phase separation device to obtain a water phase containing the water soluble mercury complex and a crude oil having a reduced concentration of mercury.

17. The method of claim 16, wherein the mixing is for a sufficient amount of time for the crude oil to have a reduced concentration of mercury of 100 ppb or less.

18. A method for reducing mercury in a crude oil, comprising:

providing a crude oil containing mercury in an oil-water emulsion;

mixing the crude oil with a composition comprising an amine or ammonium derivative with tetrakis(hydroxymethyl)phosphonium chloride for a sufficient amount of time to form a water soluble mercury complex in the oil-water emulsion; and separating the oil-water emulsion in a phase separation device to obtain a water phase containing the water soluble mercury complex and a crude oil having a reduced concentration of mercury.

* * * * *